US008293169B2

(12) United States Patent
Semba et al.

(10) Patent No.: US 8,293,169 B2
(45) Date of Patent: Oct. 23, 2012

(54) NI-BASE HEAT RESISTANT ALLOY

(75) Inventors: Hiroyuki Semba, Osaka (JP); Atsuro Iseda, Osaka (JP); Hiroyuki Hirata, Osaka (JP); Kaori Kawano, Osaka (JP); Masaaki Igarashi, Osaka (JP); Osamu Miyahara, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 13/070,689

(22) Filed: Mar. 24, 2011

(65) Prior Publication Data

US 2011/0223055 A1 Sep. 15, 2011

Related U.S. Application Data

(63) Continuation of application No. PCT/JP2009/067153, filed on Oct. 1, 2009.

(30) Foreign Application Priority Data

Oct. 2, 2008 (JP) ..... 2008-257443

(51) Int. Cl.
*C22C 19/05* (2006.01)

(52) U.S. Cl. ..... 420/450

(58) Field of Classification Search ..... 420/443, 420/450; 148/410
See application file for complete search history.

(56) References Cited

U.S. PATENT DOCUMENTS

2003/0005981 A1* 1/2003 Ogawa et al. ..... 148/428

FOREIGN PATENT DOCUMENTS

| | | |
|---|---|---|
| JP | 51-084726 | 7/1976 |
| JP | 51-084727 | 7/1976 |
| JP | 07-150277 | 6/1995 |
| JP | 07-216511 | 8/1995 |
| JP | 08-127848 | 5/1996 |
| JP | 08-218140 | 8/1996 |
| JP | 09-157779 | 6/1997 |
| JP | 10-096038 | 4/1998 |
| JP | 2002-180169 | 6/2002 |
| JP | 2002-518599 | 6/2002 |
| JP | 2004-00300 | 1/2004 |

* cited by examiner

*Primary Examiner* — Jessee R. Roe
(74) *Attorney, Agent, or Firm* — Clark & Brody

(57) ABSTRACT

A high strength, ductile, and tough Ni-base heat resistant alloy comprises by mass percent, C: 0.1% or less, Si: 1% or less, Mn: 1% or less, Cr: not less than 15% to less than 28%, Fe: 15% or less, W: more than 5% to not more than 20%, Al: more than 0.5% to not more than 2%, Ti: more than 0.5% to not more than 2%, Nd: 0.001 to 0.1% and B: 0.0005 to 0.01%, with the balance being Ni and impurities. Impurity contents of P, S, Sn, Pb, Sb, Zn and As are P: 0.03% or less, S: 0.01% or less, Sn: 0.020% or less, Pb: 0.010% or less, Sb: 0.005% or less, Zn: 0.005% or less and As: 0.005% or less, and formulas of [$0.015 \leqq Nd+13.4 \times B \leqq 0.13$], [$Sn+Pb \leqq 0.025$] and [$Sb+Zn+As \leqq 0.010$] are met.

4 Claims, No Drawings

NI-BASE HEAT RESISTANT ALLOY

This application is a continuation of the international application PCT/JP2009/067153 filed on Oct. 1, 2009, the entire content of which is herein incorporated by reference.

TECHNICAL FIELD

The present invention relates to a Ni-base heat resistant alloy. More particularly, the present invention relates to a high strength Ni-base heat resistant alloy which is excellent in hot workability and also excellent in ductility and toughness after a long period of use, which is used as a pipe material, a thick plate material for a heat resistant pressure member, a bar material, a forging, and the like for a boiler for power generation, a plant for chemical industry, and the like.

BACKGROUND ART

In recent years, Ultra Super Critical Boilers of high efficiency, with enhanced steam temperature and pressure, have been built in the world. Specifically, to increase a steam temperature, which was about 600° C., to 650° C. or more or further to 700° C. or more, has been planned. Energy saving, efficient use of resources and reduction in the $CO_2$ emission for environmental protection are the objects for solving energy problems, which are based on important industrial policies. And the high efficient Ultra Super Critical Boiler and furnace are advantageous for a boiler for power generation and a furnace for chemical industry, which burn fossil fuel.

High temperature and high pressure steam increases the temperature of a superheater tube for a boiler and a furnace tube for chemical industry, and a thick plate material and a forging, which are used as a heat resistant pressure member, and the like, during the actual operation, to 700° C. or more. Therefore, not only high temperature strength and high temperature corrosion resistance, but also excellent stability of a microstructure for a long period of time, excellent creep rupture ductility and excellent creep fatigue strength are required for the material used in such a severe environment for a long period of time.

Further, in the case of maintenance operations such as repairs after a long period of use, a material deteriorated by aging in a long period of time needs to be cut, worked, or welded, and therefore, in recent years, not only the characteristics for a new material but also the soundness for an aged material have been strongly required. In addition, from a viewpoint of practical use, the improvement in hot workability for the material used in the said severe environment has also been strongly required.

With regard to the above-described severe requirements, an Fe-base alloy such as an austenitic stainless steel suffers lack of creep rupture strength. Therefore, it is inevitable to use a Ni-base alloy in which the precipitation of a Y' phase or the like is utilized.

Thus, the Patent Documents 1 to 8 disclose Ni-base alloys that contain Mo and/or W in order to achieve solid solution strengthening, and also contain Al and Ti in order to utilize precipitation strengthening of the Y' phase, which is an intermetallic compounds and the specific formation thereof is $Ni_3(Al, Ti)$, for use in such a severe high temperature environment mentioned above. Furthermore, the alloys disclosed in the Patent Documents 4 to 6 contain 28% or more of Cr; and therefore a large amount of α-Cr phases having a bcc structure precipitate in the said alloys.

CITATION LIST

Patent Document

Patent Document 1: JP 51-84726 A
Patent Document 2: JP 51-84727 A
Patent Document 3: JP 7-150277 A
Patent Document 4: JP 7-216511 A
Patent Document 5: JP 8-127848 A
Patent Document 6: JP 8-218140 A
Patent Document 7: JP 9-157779 A
Patent Document 8: JP 2002-518599 A

SUMMARY OF THE INVENTION

Problems to be Solved by the Invention

Since the Y' phase and/or the α-Cr phase precipitate in the Ni-base alloys disclosed in the Patent Documents 1 to 8, the ductility of the said Ni-base alloys is lower than that of the conventional austenitic steel and the like; and therefore, especially in the case where the said Ni-base alloys are used for a long period of time, owing to the deterioration of aging, the ductility and toughness thereof decrease greatly as compared with those of a new material.

In the periodic inspection after the long period of use and the maintenance operations performed on account of an accident or a trouble during the use, a defective material should be cut out partially and be replaced with a new material; and in this case, the said new material should be welded to the aged material to be used continuously. Moreover, depending on the situation, a partial bending work should be carried out.

At this time, crackings due to welding and/or working occur on the aged material in which the ductility and toughness have been decreased; and therefore a trouble in welding and/or working may come about. In addition, if the aged material is further used in a continuous manner, a fatal accident such as bursting may occur during the plant operation.

However, the Patent Documents 1 to 8 do not disclose measures to restrain the deterioration in material caused by the long period of use mentioned above. That is to say, in the Patent Documents 1 to 8, no studies are conducted on how the deterioration due to the long period of use is restrained, and how a safe and reliable material is ensured in a present large plant which is used in a high temperature and high pressure environment that the past plant did not have.

Moreover, in recent years, in order to facilitate hot working of the Ni-base alloy having high deformation resistance by increasing the heating temperature even slightly, and further in order to restrain the occurrence of defects, such as a two-piece crack and a scab, caused by a phenomenon that the internal temperature of the material becomes higher than the heating temperature on account of a work heat generation at the time of pipe-making using a hot extrusion process, it is required to further improve the zero ductility temperature and the hot workability of the Ni-base heat resistant alloy. However, the techniques disclosed in the Patent Documents 1 to 8 also do not meet this requirement sufficiently.

The present invention has been made in view of the above-mentioned state of affairs, and accordingly the objective thereof is to provide a Ni-base heat resistant alloy in which the creep rupture strength is improved by the solid solution strengthening and the precipitation strengthening of the Y' phase, much higher strength and remarkable improvement in ductility and toughness after a long period of use at a high temperature are achieved, and the hot workability is also improved.

Means for Solving the Problems

In order to solve the above-described problems, the present inventors examined the creep rupture strength, the creep rupture ductility, the hot workability and the like by using various kinds of Ni-base alloys that contain various amounts of Al and Ti to allow the precipitation strengthening of the Y' phase to be utilized. As a result, the present inventors obtained the following findings (a) to (d).

(a) Conventionally, as disclosed in the Patent Documents 1 and 7, the Ni-base alloy contains Mo and/or W as solid solution strengthening elements. From the atomic weights of both the elements, it has been considered that an almost equivalent effect can be achieved by [Mo=0.5×W] by mass percent; and therefore, the elements have been adjusted by a so-called "Mo equivalent" represented by the formula of [Mo+0.5×W]. However, even if the Mo equivalent is the same, for the hot workability and the zero ductility temperature on the so-called "high temperature side" of about 1150° C. or higher, much better characteristics can be obtained in the case where the alloy contains W. Therefore, from the viewpoint of hot workability on the high temperature side, it is more advantageous for the alloy to contain W.

(b) Mo and W dissolve into the Y' phase which precipitates in the alloys containing Al and Ti. However, even if the Mo equivalent is the same, a large amount of W dissolve into the Y' phase, so that the coarsening of Y' phase during the long period of use is restrained. Therefore, from the viewpoint of ensuring a high creep rupture strength stably on the long term side at a high temperature; it is more advantageous for the alloy to contain W.

(c) Although Mo and W are elements that are considered to achieve an almost equivalent effect by [Mo=0.5×W] in the Patent Documents 1 and 7, from the viewpoints of the above items (a) and (b), W of an amount exceeding 5% by mass percent contained as an essential element can lead to an improvement of the hot workability and the creep rupture strength simultaneously on the high temperature side.

(d) If Nd and B, the former has the effects of improving the adherence of an oxide film and hot workability, and the latter has the effect of a grain boundary strengthening, are contained compositely, and a value represented by the formula of [Nd+13.4×B] is controlled to a specific range, the creep rupture strength and the rupture ductility, and further the hot workability on the so-called "low temperature side" of about 1000° C. or lower can be remarkably enhanced.

Next, the present inventors made further detailed studies of the deterioration in the Ni-base heat resistant alloy caused by the long period of use using materials subjected to creep rupture tests at a temperature of 700° C. or higher for a long period of time of 10,000 hours or longer and various materials subjected to similar long term aging tests. As a result, the present inventors obtained the following important findings (e) and (f).

(e) Impurities mixed in the melting process, specifically, Sn, Pb, Sb, Zn and As have a significant effect on the ductility and toughness after a long period of heating at a high temperature, that is to say, a significant effect on the workability of the material aged in a long period of time. Therefore, in order to restrain the deterioration in material caused by the long period of use, it is effective to control the contents of the above-described elements to specific ranges.

(f) In order to remarkably improve the ductility and toughness after a long period of heating at a high temperature, in addition to the control of each content of the elements described in the above item (e) to specific range, it becomes essential that the sum of the contents of Sn and Pb should be 0.025% or less, and moreover the sum of the contents of Sb, Zn and As should be 0.010% or less.

The present invention has been accomplished on the basis of the above-described new findings, which are not shown at all in the Patent Documents 1 to 8. The main points of the present invention are Ni-base heat resistant alloys shown in the following (1) to (3).

(1) A Ni-base heat resistant alloy, which comprises by mass percent, C: 0.1% or less, Si: 1% or less, Mn: 1% or less, Cr: not less than 15% to less than 28%, Fe: 15% or less, W: more than 5% to not more than 20%, Al: more than 0.5% to not more than 2%, Ti: more than 0.5% to not more than 2%, Nd: 0.001 to 0.1% and B: 0.0005 to 0.01%, with the balance being Ni and impurities, in which the contents of P, S, Sn, Pb, Sb, Zn and As among the impurities are P: 0.03% or less, S: 0.01% or less, Sn: 0.020% or less, Pb: 0.010% or less, Sb: 0.005% or less, Zn: 0.005% or less and As: 0.005% or less, and further satisfies the following formulas (1) to (3):

$$0.015 \leqq Nd+13.4\times B \leqq 0.13 \quad (1),$$

$$Sn+Pb \leqq 0.025 \quad (2),$$

$$Sb+Zn+As \leqq 0.010 \quad (3):$$

wherein each element symbol in the formulas (1) to (3) represents the content by mass percent of the element concerned.

(2) The Ni-base heat resistant alloy according to the above (1), which further contains, by mass percent, one or more elements of 15% or less of Mo satisfying the following formula (4) and 20% or less of Co in lieu of a part of Ni:

$$Mo+0.5\times W \leqq 18 \quad (4);$$

wherein each element symbol in the formula (4) represents the content by mass percent of the element concerned.

(3) The Ni-base heat resistant alloy according to the above (1) or (2), which further contains, by mass percent, one or more elements of one or more groups selected from the following groups <1> to <3> in lieu of a part of Ni:

<1> Nb: 1.0% or less, V: 1.5% or less, Zr: 0.2% or less and Hf: 1% or less,

<2> Mg: 0.05% or less, Ca: 0.05% or less, Y: 0.5% or less, La: 0.5% or less and Ce: 0.5% or less, <3> Ta: 8% or less and Re: 8% or less.

The term "impurities" so referred to in the phrase "the balance being Ni and impurities" indicates those impurities which come from ores and scraps as raw materials, environments, and so on in the industrial production of Ni-base heat resistant alloys.

Effects of the Invention

The Ni-base heat resistant alloy of the present invention is an alloy in which much higher strength than the conventional Ni-base heat resistant alloy can be achieved, the ductility and toughness after a long period of use at a high temperature are remarkably improved, and moreover the zero ductility temperature and the hot workability are also further improved. Therefore, this Ni-base heat resistant alloy can be suitably used as a pipe material, a thick plate material for a heat resistant pressure member, a bar material, a forging, and the like for a boiler for power generation, a plant for chemical industry, and the like.

MODES FOR CARRYING OUT THE INVENTION

Hereunder, the requirements of the present invention are described in detail. In the following description, the symbol "%" for the content of each element means "% by mass".

C: 0.1% or less

C (carbon) is an element effective in securing tensile strength and creep strength, by forming carbides, which are necessary when the material is used in a high temperature environment; and therefore, C is contained appropriately in the present invention. However, if the C content exceeds 0.1%, the amount of undissolved carbides in a solution state increases, so that not only carbon does not contribute to the improvement in high temperature strength but also carbon deteriorates the mechanical properties such as toughness and the weldability. Therefore, the content of C is set to 0.1% or less. The content of C is preferably 0.08% or less.

In order to ensure the above-described effect of improving the high temperature strength due to C, the lower limit of the C content is preferably set to 0.005%, and further preferably set to more than 0.015%. The lower limit of the C content is still further preferably set to more than 0.025%.

Si: 1% or less

Si (silicon) is added as a deoxidizing element. In the case where the content of Si increases and especially it exceeds 1%, the weldability and hot workability of the alloy decrease. Further, in such a case, the formation of intermetallic compounds such as the σ phase is promoted, so that the structural stability at high temperatures does deteriorate, and the toughness and ductility decrease. Therefore, the content of Si is set to 1% or less. The content of Si is preferably 0.8% or less, and further preferably 0.5% or less. In the case where the deoxidizing action has been ensured by any other element, it is not necessary to regulate the lower limit of the Si content.

Mn: 1% or less

Like Si, Mn (manganese) has a deoxidizing effect. Mn also has the effect of fixing S, which is inevitably contained in the alloy, as sulfides, and therefore Mn does improve the hot workability. However, if the Mn content increases, the formation of spinel type oxide films is promoted, so that the oxidation resistance at high temperatures is deteriorated. Therefore, the content of Mn is set to 1% or less. The content of Mn is preferably 0.8% or less, and further preferably 0.5% or less.

Cr: not less than 15% to less than 28%

Cr (chromium) is an important element for achieving an effect excellent in improving the corrosion resistance such as oxidation resistance, steam oxidation resistance, and high temperature corrosion resistance. However, if the content of Cr is less than 15%, these desired effects cannot be obtained. On the other hand, in the present invention, Al and Ti are contained to utilize the precipitation strengthening of the Y' phase, which is an intermetallic compound; and therefore, if the Cr content is not less than 28%, the α-Cr phase precipitates as shown in the Patent Documents 4 to 6, which may lead to a decrease in the ductility and toughness after the long period of use due to excessive precipitates. Further, the hot workability also does deteriorate. Therefore, the content of Cr is set to not less than 15% to less than 28%. The lower limit of the Cr content is preferably 18%. In addition, the content of Cr is preferably 27% or less, and more preferably 26% or less.

Fe: 15% or less

Fe (iron) has an action of improving the hot workability of the Ni-base alloy; and therefore, Fe is contained appropriately in the present invention. However, if the Fe content exceeds 15%, the oxidation resistance and structural stability do deteriorate. Therefore, the content of Fe is set to 15% or less. In the case where much importance is attached to the oxidation resistance, the content of Fe is preferably set to 10% or less.

W: more than 5% to not more than 20%

W (tungsten) is one of the important elements which characterize the present invention. That is to say, W is an element which contributes to the improvement in creep rupture strength as a solid solution strengthening element by dissolving into the matrix. W dissolves into the Y' phase, and has an action of restraining the growing and coarsening of the Y' phase during a long period of creep at a high temperature; and therefore, W stably attains the long period of creep rupture strength. Furthermore, even if the Mo equivalent is the same, W has the following features as compared with Mo:

[1] The zero ductility temperature is high, and excellent hot workability especially on the so-called "high temperature side" of about 1150° C. or higher can be secured;

[2] A larger amount of W dissolve into the Y' phase; and therefore, W restrains the coarsening of the Y' phase during the long period of use at a high temperature, and can stably ensure the high creep rupture strength on the long term side at a high temperature.

In order to obtain the above-described effects, a content of W more than 5% is necessary. However, if the content of W increases and especially exceeds 20%, the structural stability and hot workability do deteriorate. Therefore, the content of W is set to more than 5% to not more than 20%.

In order to ensure the above-described effects due to W stably, the content of W is preferably set to more than 6%. In addition, the upper limit of the W content is preferably set to 15%, and more preferably set to 12%.

In the case where further solid solution strengthening is aimed at or much importance is attached to the structural stability on the so-called "low temperature side" of about 1000° C. or lower, in addition to W of the above-described range, Mo of the later-described amount may also be contained in consideration of keeping the balance with the hot workability.

In the case where Mo is also contained, besides restricting the W content to the range of the above-described "more than 5% to not more than 20%", the sum of the Mo content and the half of the W content, that is to say, the value represented by the formula of [Mo+0.5×W] should be set to 18% or less.

Al: more than 0.5% to not more than 2%

Al (aluminum) is an important element in the Ni-base alloy. That is to say, Al precipitates as the Y' phase, which is an intermetallic compound, specifically as $Ni_3Al$, and improves the creep rupture strength remarkably. In order to obtain this effect, a content of Al more than 0.5% is necessary. However, if the content of Al exceeds 2%, the hot workability does decrease, and it becomes difficult to carry out the working such as hot forging and hot pipe-making. Therefore, the content of Al is set to more than 0.5% to not more than 2%.

The lower limit of the Al content is preferably set to 0.8%, and more preferably set to 0.9%. In addition, the upper limit of the Al content is preferably set to 1.8%, and further preferably set to 1.7%.

Ti: more than 0.5% to not more than 2%

Ti (titanium) is an important element in the Ni-base alloy. That is to say, Ti forms the Y' phase, which is an intermetallic compound, specifically $Ni_3(Al, Ti)$ together with Al, and improves the creep rupture strength remarkably. In order to obtain this effect, a content of Ti more than 0.5% is necessary. However, if the content of Ti increases and exceeds 2%, the hot workability does decrease, and it becomes difficult to carry out the working such as hot forging and hot pipe-making. Therefore, the content of Ti is set to more than 0.5% to not more than 2%.

The lower limit of the Ti content is preferably set to 0.8%, and more preferably set to 1.1%. In addition, the upper limit of the Ti content is preferably set to 1.8%, and further preferably set to 1.7%.

Nd: 0.001 to 0.1%

Nd (neodymium) is an important element which characterizes the present invention together with the later-described B. That is to say, Nd is an element having the effects of improving the adhesiveness of an oxide film and of improving the hot workability. If Nd is contained so as to satisfy the later-described formula (1) besides being contained compositely with B, Nd achieves an effect of remarkably improving the creep rupture strength and rupture ductility and the hot workability on the so-called "low temperature side" of about 1000° C. or lower of the Ni-base heat resistant alloy of the present invention. In order to obtain the above-described effect, a content of Nd 0.001% or more is necessary. However, if the content of Nd becomes excessive and especially exceeds 0.1%, the hot workability does deteriorate on the contrary. Therefore, the content of Nd is set to 0.001 to 0.1%.

The lower limit of the Nd content is preferably set to 0.003%, and more preferably set to 0.005%. In addition, the upper limit of the Nd content is set to preferably 0.08%, and further preferably set to 0.06%.

B: 0.0005 to 0.01%

B (boron) is an important element which characterizes the present invention together with the aforementioned Nd. That is to say, B has the effect of strengthening the grain boundaries. If B is contained so as to satisfy the later-described formula (1) besides being contained compositely with Nd, B achieves an effect of remarkably improving the creep rupture strength and rupture ductility and the hot workability on the so-called "low temperature side" of about 1000° C. or lower of the Ni-base heat resistant alloy of the present invention. In order to obtain the above-described effect, a content of B 0.0005% or more is necessary. However, if the content of B becomes excessive and especially exceeds 0.01%, in addition to the deterioration in weldability, the hot workability does deteriorate on the contrary. Therefore, the content of B is set to 0.0005 to 0.01%.

The lower limit of the B content is preferably set to 0.001%, and more preferably set to 0.002%. In addition, the upper limit of the B content is preferably set to 0.008%, and further preferably set to 0.006%.

The value represented by the formula of [Nd+13.4×B]: 0.015 to 0.13

The Ni-base heat resistant alloy of the present invention should be such that the contents of Nd and B are in the above-described ranges, respectively, and satisfy the following formula:

$$0.015 \leqq Nd+13.4\times B \leqq 0.13 \quad (1).$$

The reason is as follows. Even if the contents of Nd and B are in the already-described ranges, respectively, in the case where the value represented by the formula of [Nd+13.4×B] is smaller than 0.015, the effect of remarkably improving the creep rupture strength and rupture ductility and the hot workability on the so-called "low temperature side" of about 1000° C. or lower of the Ni-base heat resistant alloy of the present invention cannot be obtained, and in the case where the value represented by the formula of [Nd+13.4×B] exceeds 0.13, the hot workability does deteriorate on both the "low temperature side" and "high temperature side" on the contrary, and in some cases, the weldability does also deteriorate.

The lower limit of the value represented by the formula of [Nd+13.4×B] is preferably set to 0.020, and more preferably set to 0.025. In addition, the upper limit of the value represented by the said formula is preferably set to 0.11, and further preferably set to 0.10.

One Ni-base heat resistant alloys of the present invention comprises the above-described elements with the balance being Ni and impurities. Incidentally, the contents of P, S, Sn, Pb, Sb, Zn and As among the impurities should be restricted as described below.

First, in the following, P and S will be explained.

P: 0.03% or less

P (phosphorus) is inevitably mingled in the alloy as an impurity, and remarkably deteriorates the weldability and hot workability. In particular, if the content of P exceeds 0.03%, the weldability and hot workability deteriorate remarkably. Therefore, the content of P is set to 0.03% or less. The content of P is preferably as low as possible; and so, the content of P is preferably set to 0.02% or less, and further preferably set to 0.015% or less.

S: 0.01% or less

Like P, S (sulfur) is inevitably mingled in the alloy as an impurity, and remarkably deteriorates the weldability and hot workability. In particular, if the content of S exceeds 0.01%, the weldability and hot workability deteriorate remarkably. Therefore, the content of S is set to 0.01% or less.

In the case where much importance is attached to the hot workability, the content of S is preferably set to 0.005% or less, and further preferably set to 0.003% or less.

Next, Sn, Pb, Sb, Zn and As will be explained.

Sn: 0.020% or less

Pb: 0.010% or less

Sb: 0.005% or less

Zn: 0.005% or less

As: 0.005% or less

All of Sn, Pb, Sb, Zn and As are impurity elements mingled in the melting process, and cause a remarkable decrease in the ductility and toughness after a long period of heating at a high temperature of 700° C. or higher for 10,000 hours or longer. Therefore, in order to secure excellent workability such as bending workability and weldability of the material aged in a long period of time, first, the contents of these elements should be restricted to Sn: 0.020% or less, Pb: 0.010% or less, Sb: 0.005% or less, Zn: 0.005% or less, and As: 0.005% or less, respectively.

The value represented by the formula of [Sn+Pb]: 0.025 or smaller

The value represented by the formula of [Sb+Zn+As]: 0.010 or smaller

The Ni-base heat resistant alloy of the present invention should be such that the contents of Sn, Pb, Sb, Zn and As are in the above-described ranges, respectively, and satisfy the following two formulas:

$$Sn+Pb \leqq 0.025 \quad (2),$$

$$Sb+Zn+As \leqq 0.010 \quad (3).$$

The reason is as follows. Even if the contents of Sn and Pb are in the already-described ranges, respectively, in the case where the value represented by the formula of [Sn+Pb] exceeds 0.025, the remarkable decrease in the ductility and toughness after a long period of heating at a high temperature cannot be restrained, and similarly, in the case where the value represented by the formula of [Sb+Zn+As] exceeds 0.010, the remarkable decrease in the ductility and toughness after a long period of heating at a high temperature cannot be restrained.

The values represented by the above-described two formulas are preferably as small as possible.

Hereunder, Ni in the phrase "the balance Ni and impurities" of the Ni-base heat resistant alloy of the present invention is explained.

Ni (nickel) is an element for stabilizing the austenitic microstructure, and is an element important for securing excellent corrosion resistance as well in the Ni-base heat resistant alloy of the present invention. In the present invention, it is not necessary to regulate the content of Ni especially. The content of Ni is defined as the content obtained by removing the content of impurities from the balance. However, the content of Ni in the balance is preferably more than 50%, and further preferably more than 60%.

Another Ni-base heat resistant alloys of the present invention further contains one or more elements selected from Mo, Co, Nb, V, Zr, Hf, Mg, Ca, Y, La, Ce, Ta and Re, in addition to the above-described elements, in lieu of a part of Ni.

Hereunder, the working-effects of these optional elements and the reasons for restricting the contents thereof will be explained.

Mo and Co

Each of Mo and Co has a solid solution strengthening action. Therefore, in the case where it is desired to obtain far higher strength by the solid solution strengthening effect, these elements are added positively, and may be contained in the range described below.

Mo: 15% or less

Mo (molybdenum) has a solid solution strengthening action. Mo also has an action of enhancing the structural stability on the so-called "low temperature side" of about 1000° C. or lower. Therefore, in the case where further solid solution strengthening is aimed at or much importance is attached to the structural stability on the "low temperature side", Mo may be contained. However, if the content of Mo increases and exceeds 15%, the hot workability does deteriorate remarkably. Therefore, in the case where Mo is added, the content of Mo is set to 15% or less. In the case where Mo is added, the content of Mo is preferably set to 12% or less, and more preferably set to 11% or less.

On the other hand, in order to ensure the above-described effects due to Mo, the lower limit of the Mo content is preferably set to 3%, and further preferably set to 5%.

The value represented by the formula of [Mo+0.5×W]: 18 or smaller

In the case where Mo is added positively and contained, the Ni-base heat resistant alloy of the present invention should be such that the content of Mo is in the above-described range, and satisfies the following formula:

$$Mo+0.5\times W \leqq 18 \quad (4).$$

The reason is as follows. Even if the contents of W and Mo are in the already-described ranges, respectively, in the case where the value represented by the formula of [Mo+0.5×W] exceeds 18, the hot workability does decrease remarkably.

The upper limit of the value represented by the formula of [Mo+0.5×W] is preferably set to 15, and more preferably set to 13. In addition, the lower limit of the value represented by the said formula is a value close to 2.5 in the case where the content of W is a value close to 5%.

Co: 20% or less

Co (cobalt) has a solid solution strengthening action. Specifically, Co dissolves into the matrix and improves the creep rupture strength. Therefore, in order to obtain such effect, Co may be contained. However, if the content of Co increases and exceeds 20%, the hot workability does decrease. Therefore, in the case where Co is added, the content of Co is set to 20% or less. In the case where Co is added, the content of Co is preferably set to 15% or less, and more preferably set to 13% or less.

On the other hand, in order to ensure the above-described effects due to Co, a content of Co more than 5% is preferable. A content of Co not less than 7% is further preferable.

The Ni-base heat resistant alloy of the present invention can contain only one or a combination of the above-mentioned Mo and Co. The total content of these elements is preferably set to 27% or less.

<1> Nb: 1.0% or less, V: 1.5% or less, Zr: 0.2% or less and Hf: 1% or less

Each of Nb, V, Zr and Hf being elements of the <1> group, has the action of enhancing the creep rupture strength. Therefore, in the case where it is desired to obtain the enhanced creep rupture strength, these elements are added positively, and may be contained in the range described below.

Nb: 1.0% or less

By forming the Y' phase together with Al and Ti, .Nb (niobium) has the effect of enhancing the creep rupture strength. Therefore, in order to obtain this effect, Nb may be contained. However, if the content of Nb exceeds 1.0%, the hot workability and toughness do deteriorate. Therefore, in the case where Nb is added, the content of Nb is set to 1.0% or less. The content of Nb is preferably set to 0.9% or less.

On the other hand, in order to ensure the above-described effect due to Nb, the lower limit of the Nb content is preferably set to 0.05%, and further preferably set to 0.1%.

V: 1.5% or less

V (vanadium) has the effect of enhancing the creep rupture strength by forming carbo-nitrides. Therefore, in order to obtain this effect, V may be contained. However, if the content of V exceeds 1.5%, the ductility and toughness do deteriorate on account of the occurrence of high temperature corrosion and the precipitation of brittle phase. Therefore, in the case where V is added, the content of V is set to 1.5% or less. The content of V is preferably set to 1% or less.

On the other hand, in order to ensure the above-described effect due to V, the content of V is preferably set to 0.02% or more, and further preferably set to 0.04% or more.

Zr: 0.2% or less

Zr (zirconium) is a grain boundary strengthening element, and has the effect of enhancing the creep rupture strength. Zr also has the effect of enhancing the creep rupture ductility. Therefore, in order to obtain these effects, Zr may be contained. However, if the content of Zr exceeds 0.2%, the hot workability does deteriorate. Therefore, in the case where Zr is added, the content of Zr is set to 0.2% or less. The content of Zr is preferably set to 0.1% or less, and more preferably set to 0.05% or less.

On the other hand, in order to ensure the above-described effect due to Zr, the content of Zr is preferably set to 0.005% or more, and further preferably set to 0.01% or more.

Hf: 1% or less

Hf (hafnium) has the effect of enhancing the creep rupture strength by contributing mainly to grain boundary strengthening, so that in order to obtain this effect, Hf may be contained. However, if the content of Hf exceeds 1%, the workability and weldability are impaired. Therefore, in the case where Hf is added, the content of Hf is set to 1% or less. The upper limit of the Hf content is preferably set to 0.8%, and more preferably set to 0.5%.

On the other hand, in order to ensure the above-described effect due to Hf, the content of Hf is preferably set to 0.005% or more, and further preferably set to 0.01% or more.

The Ni-base heat resistant alloy of the present invention can contain only one or a combination of two or more of the above-mentioned Nb, V, Zr and Hf. The total content of these elements is preferably set to 2.8% or less.

<2> Mg: 0.05% or less, Ca: 0.05% or less, Y: 0.5% or less, La: 0.5% or less and Ce: 0.5% or less Each of Mg, Ca, Y, La and Ce being elements of the (2) group, has the effect of improving the hot workability by fixing S as sulfides. Therefore, in the case where it is desired to obtain further excellent hot workability, these elements are added positively, and may be contained in the range described below.

Mg: 0.05% or less

Mg (magnesium) has the effect of improving the hot workability by fixing S, which hinders the hot workability, as sulfides. Therefore, in order to obtain this effect, Mg may be contained. However, if the content of Mg exceeds 0.05%, the cleanliness of the alloy decreases; and therefore, the hot workability and ductility do deteriorate on the contrary. Therefore, in the case where Mg is added, the content of Mg is set to 0.05% or less. The upper limit of the Mg content is preferably set to 0.02%, and more preferably set to 0.01%.

On the other hand, in order to ensure the above-described effect due to Mg, the lower limit of the Mg content is preferably set to 0.0005%, and more preferably set to 0.001%.

Ca: 0.05% or less

Ca (calcium) has the effect of improving the hot workability by fixing S, which hinders the hot workability, as sulfides. Therefore, in order to obtain this effect, Ca may be contained. However, if the content of Ca exceeds 0.05%, the cleanliness of the alloy decreases; and therefore, the hot workability and ductility do deteriorate on the contrary. Therefore, in the case where Ca is added, the content of Ca is set to 0.05% or less. The upper limit of the Ca content is preferably set to 0.02%, and more preferably set to 0.01%.

On the other hand, in order to ensure the above-described effect due to Ca, the content of Ca is preferably set to 0.0005% or more, and further preferably set to 0.001% or more.

Y: 0.5% or less

Y (yttrium) has the effect of improving the hot workability by fixing S as sulfides. Y also has the effect of improving the adhesiveness of a $Cr_2O_3$ protective film on the alloy surface, especially improving the oxidation resistance at the time of repeated oxidation, and further Y has the effects of enhancing the creep rupture strength and creep rupture ductility by contributing to grain boundary strengthening. Therefore, in order to obtain these effects, Y may be contained. However, if the content of Y exceeds 0.5%, the amounts of inclusions, such as oxides increase, so that the workability and weldability are impaired. Therefore, in the case where Y is added, the content of Y is set to 0.5% or less. The upper limit of the Y content is preferably set to 0.3%, and further preferably set to 0.15%.

On the other hand, in order to ensure the above-described effects due to Y, the lower limit of the Y content is preferably set to 0.0005%. The lower limit of the Y content is more preferably 0.001%, and still more preferably 0.002%.

La: 0.5% or less

La (lanthanum) has the effect of improving the hot workability by fixing S as sulfides. La also has the effect of improving the adhesiveness of a $Cr_2O_3$ protective film on the alloy surface, especially improving the oxidation resistance at the time of repeated oxidation, and further La has the effects of enhancing the creep rupture strength and creep rupture ductility by contributing to grain boundary strengthening. Therefore, in order to obtain these effects, La may be contained. However, if the content of La exceeds 0.5%, the amounts of inclusions, such as oxides increase, so that the workability and weldability are impaired. Therefore, in the case where La is added, the content of La is set to 0.5% or less. The upper limit of the La content is preferably set to 0.3%, and further preferably set to 0.15%.

On the other hand, in order to ensure the above-described effects due to La, the lower limit of the La content is preferably set to 0.0005%. The lower limit of the La content is more preferably 0.001%, and still more preferably 0.002%.

Ce: 0.5% or less

Ce (cerium) also has the effect of improving the hot workability by fixing S as sulfides. In addition, Ce has the effect of improving the adhesiveness of a $Cr_2O_3$ protective film on the alloy surface, especially improving the oxidation resistance at the time of repeated oxidation, and further Ce has the effects of enhancing the creep rupture strength and creep rupture ductility by contributing to grain boundary strengthening. Therefore, in order to obtain these effects, Ce may be contained. However, if the content of Ce exceeds 0.5%, the amounts of inclusions, such as oxides increase, so that the workability and weldability are impaired. Therefore, in the case where Ce is added, the content of Ce is set to 0.5% or less. The upper limit of the Ce content is preferably set to 0.3%, and further preferably set to 0.15%.

On the other hand, in order to ensure the above-described effects due to Ce, the lower limit of the Ce content is preferably set to 0.0005%. The lower limit of the Ce content is more preferably 0.001%, and still more preferably 0.002%.

The Ni-base heat resistant alloy of the present invention can contain only one or a combination of two or more of the above-mentioned Mg, Ca, Y, La and Ce. The total content of these elements is preferably set to 0.94% or less.

<3> Ta: 8% or less and Re: 8% or less

Each of Ta and Re being elements of the (3) group, has the effect of enhancing the creep rupture strength as a solid solution strengthening element. Therefore, in the case where it is desired to obtain far higher creep rupture strength, these elements are added positively, and may be contained in the range described below.

Ta: 8% or less

By forming carbo-nitrides and as a solid solution strengthening element, Ta (tantalum) has the effect of enhancing the creep rupture strength. Therefore, in order to obtain this effect, Ta may be contained. However, if the content of Ta exceeds 8%, the workability and mechanical properties are impaired. Therefore, in the case where Ta is added, the content of Ta is set to 8% or less. The upper limit of the Ta content is preferably set to 7%, and more preferably set to 6%.

On the other hand, in order to ensure the above-described effects due to Ta, the lower limit of the Ta content is preferably set to 0.01%. The lower limit of the Ta content is more preferably 0.1%, and still further preferably 0.5%.

Re: 8% or less

Re (rhenium) has the effect of enhancing the creep rupture strength as a solid solution strengthening element. Therefore, in order to obtain this effect, Re may be contained. However, if the content of Re exceeds 8%, the workability and mechanical properties are impaired. Therefore, in the case where Re is added, the content of Re is set to 8% or less. The upper limit of the Re content is preferably set to 7%, and more preferably set to 6%.

On the other hand, in order to ensure the above-described effects due to Re, the lower limit of the Re content is preferably set to 0.01%. The lower limit of the Ta content is more preferably 0.1%, and still further preferably 0.5%.

The Ni-base heat resistant alloy of the present invention can contain only one or a combination of the above-mentioned Ta and Re. The total content of these elements is preferably set to 14% or less.

The Ni-base heat resistant alloy of the present invention can be produced by selecting the raw materials to be used in the melting step based on the results of careful and detailed analyses so that, in particular, the contents of Sn, Pb, Sb Zn and As among the impurities may fall within the above-mentioned respective ranges, namely Sn: 0.020% or less, Pb: 0.010% or less, Sb: 0.005% or less, Zn: 0.005% or less and As: 0.005% or less and satisfy the said formulas (2) and (3), and then melting the materials using an electric furnace, an AOD furnace or a VOD furnace.

The following examples illustrate the present invention more specifically. These examples are, however, by no means limited to the scope of the present invention.

EXAMPLES

Austenitic alloys 1 to 15 and A to N, having the chemical compositions shown in Tables 1 and 2, were melted by using a high-frequency vacuum furnace and cast to form 30 kg ingots.

The alloys 1 to 15 shown in Tables 1 and 2 are alloys whose chemical compositions fall within the range regulated by the present invention. On the other hand, the alloys A to N are alloys of comparative examples whose chemical compositions are out of the range regulated by the present invention. Both of the alloys F and G are alloys in which the individual contents of Nb and B are within the range regulated by the present invention, the value of [Nd+13.4×B] does not satisfy the said formula (1). In addition, the alloy M is an alloy in which the individual contents of Sn and Pb are within the range regulated by the present invention, the value of [Sn+Pb] does not satisfy the said formula (2). The alloy N is an alloy in which the individual contents of Sb, Zn and As are within the range regulated by the present invention, the value of [Sb+Zn+As] does not satisfy the said formula (3).

TABLE 1

| | | Chemical composition (% by mass) Balance: Ni and impurities | | | | | | | | | | | | | |
|---|---|---|---|---|---|---|---|---|---|---|---|---|---|---|---|
| Division | Alloy | C | Si | Mn | P | S | Cr | Fe | W | Mo | Co | Al | Ti | Nd | B |
| Inventive examples | 1 | 0.059 | 0.17 | 0.23 | 0.011 | 0.001 | 21.49 | 0.60 | 6.21 | — | — | 1.22 | 1.44 | 0.014 | 0.0032 |
| | 2 | 0.057 | 0.21 | 0.16 | 0.013 | 0.001 | 21.38 | 0.62 | 11.86 | — | — | 1.28 | 1.39 | 0.012 | 0.0036 |
| | 3 | 0.061 | 0.16 | 0.18 | 0.012 | 0.001 | 21.14 | 0.57 | 18.35 | — | — | 1.18 | 1.49 | 0.015 | 0.0028 |
| | 4 | 0.058 | 0.20 | 0.19 | 0.012 | 0.001 | 21.06 | 0.65 | 8.51 | — | — | 1.25 | 1.43 | 0.012 | 0.0008 |
| | 5 | 0.062 | 0.19 | 0.18 | 0.011 | 0.001 | 21.21 | 0.62 | 8.75 | — | — | 1.21 | 1.46 | 0.045 | 0.0057 |
| | 6 | 0.035 | 0.18 | 0.22 | 0.012 | 0.002 | 24.15 | 0.77 | 7.72 | — | 10.27 | 1.44 | 1.51 | 0.024 | 0.0022 |
| | 7 | 0.050 | 0.20 | 0.15 | 0.015 | 0.001 | 22.03 | 0.89 | 6.43 | 8.54 | — | 1.20 | 1.18 | 0.028 | 0.0020 |
| | 8 | 0.055 | 0.22 | 0.24 | 0.011 | 0.001 | 23.37 | 0.91 | 7.07 | 6.38 | 8.72 | 1.34 | 1.55 | 0.017 | 0.0009 |
| | 9 | 0.062 | 0.24 | 0.19 | 0.014 | 0.002 | 22.25 | 1.78 | 8.86 | 7.02 | — | 0.98 | 1.19 | 0.039 | 0.0041 |
| | 10 | 0.075 | 0.21 | 0.20 | 0.011 | 0.001 | 21.86 | 1.37 | 10.74 | — | 9.56 | 1.28 | 1.62 | 0.008 | 0.0029 |
| | 11 | 0.053 | 0.14 | 0.22 | 0.016 | 0.003 | 21.78 | 1.68 | 7.25 | 6.59 | 11.26 | 1.65 | 1.22 | 0.022 | 0.0036 |
| | 12 | 0.068 | 0.53 | 0.08 | 0.017 | 0.001 | 22.64 | 0.70 | 6.87 | 10.68 | — | 1.27 | 1.56 | 0.031 | 0.0018 |
| | 13 | 0.064 | 0.25 | 0.14 | 0.012 | 0.002 | 22.17 | 0.86 | 6.91 | — | 9.29 | 1.51 | 1.24 | 0.027 | 0.0037 |
| | 14 | 0.060 | 0.19 | 0.26 | 0.013 | 0.001 | 21.91 | 0.80 | 8.05 | — | — | 1.15 | 1.29 | 0.013 | 0.0046 |
| | 15 | 0.058 | 0.05 | 0.51 | 0.012 | 0.001 | 18.57 | 0.78 | 9.06 | — | 14.63 | 1.42 | 1.37 | 0.017 | 0.0033 |
| Comparative examples | A | 0.059 | 0.19 | 0.18 | 0.013 | 0.001 | 21.45 | 0.65 | *— | 6.02 | — | 1.30 | 1.35 | 0.013 | 0.0034 |
| | B | 0.061 | 0.19 | 0.20 | 0.012 | 0.001 | 21.41 | 0.58 | *3.13 | — | — | 1.19 | 1.15 | 0.016 | 0.0030 |
| | C | 0.059 | 0.23 | 0.18 | 0.011 | 0.001 | 21.33 | 0.65 | *2.26 | 5.05 | — | 1.25 | 1.41 | 0.013 | 0.0033 |
| | D | 0.062 | 0.20 | 0.16 | 0.011 | 0.001 | 21.43 | 0.55 | 6.30 | — | — | 1.26 | 1.42 | 0.018 | *— |
| | E | 0.059 | 0.18 | 0.17 | 0.013 | 0.001 | 21.49 | 0.58 | 6.25 | — | — | 1.25 | 1.44 | *— | 0.0038 |
| | F | 0.060 | 0.22 | 0.18 | 0.012 | 0.001 | 21.15 | 0.68 | 8.47 | — | — | 1.23 | 1.39 | 0.003 | 0.0007 |
| | G | 0.065 | 0.20 | 0.19 | 0.012 | 0.001 | 21.28 | 0.66 | 8.69 | — | — | 1.24 | 1.40 | 0.061 | 0.0058 |
| | H | 0.058 | 0.17 | 0.22 | 0.013 | 0.001 | 21.51 | 0.62 | 6.24 | — | — | 1.18 | 1.47 | 0.015 | 0.0035 |
| | I | 0.037 | 0.19 | 0.20 | 0.013 | 0.002 | 24.36 | 0.74 | 7.69 | — | 10.31 | 1.48 | 1.47 | 0.022 | 0.0024 |
| | J | 0.052 | 0.23 | 0.15 | 0.014 | 0.001 | 22.12 | 0.90 | 6.45 | 8.58 | — | 1.18 | 1.17 | 0.029 | 0.0020 |
| | K | 0.053 | 0.21 | 0.26 | 0.012 | 0.001 | 23.48 | 0.85 | 7.12 | 6.35 | 8.80 | 1.39 | 1.49 | 0.019 | 0.0008 |
| | L | 0.057 | 0.20 | 0.20 | 0.012 | 0.001 | 21.54 | 0.65 | 6.33 | — | — | 1.25 | 1.44 | 0.015 | 0.0034 |
| | M | 0.060 | 0.18 | 0.22 | 0.011 | 0.001 | 21.48 | 0.67 | 6.27 | — | — | 1.21 | 1.46 | 0.013 | 0.0035 |
| | N | 0.058 | 0.25 | 0.22 | 0.012 | 0.001 | 23.35 | 0.94 | 7.21 | 6.45 | 8.83 | 1.37 | 1.51 | 0.017 | 0.0010 |

TABLE 2

(continued from Table 1)

| | | Chemical composition (% by mass) Balance: Ni and impurities | | | | | | | | | |
|---|---|---|---|---|---|---|---|---|---|---|---|
| Division | Alloy | Sn | Pb | Sb | Zn | As | Nd + 13.4 × B | Sn + Pb | Sb + Zn + As | Mo + 0.5 × W | Others |
| Inventive examples | 1 | 0.002 | 0.005 | 0.002 | 0.002 | 0.001 | 0.057 | 0.007 | 0.005 | 3.11 | — |
| | 2 | 0.002 | 0.004 | 0.003 | 0.001 | 0.002 | 0.060 | 0.006 | 0.006 | 5.93 | — |
| | 3 | 0.003 | 0.005 | 0.003 | 0.002 | 0.001 | 0.053 | 0.008 | 0.006 | 9.18 | — |
| | 4 | 0.003 | 0.003 | 0.002 | 0.001 | 0.002 | 0.023 | 0.006 | 0.005 | 4.26 | — |
| | 5 | 0.002 | 0.004 | 0.003 | 0.001 | 0.002 | 0.121 | 0.006 | 0.006 | 4.38 | — |
| | 6 | 0.002 | 0.003 | 0.001 | 0.002 | 0.002 | 0.053 | 0.005 | 0.005 | 3.86 | — |
| | 7 | 0.007 | 0.002 | 0.002 | 0.002 | 0.002 | 0.055 | 0.009 | 0.006 | 11.76 | — |
| | 8 | 0.003 | 0.001 | 0.001 | 0.004 | 0.001 | 0.029 | 0.004 | 0.006 | 9.92 | — |
| | 9 | 0.012 | 0.002 | 0.004 | 0.002 | 0.003 | 0.094 | 0.014 | 0.009 | 11.45 | V: 0.53, Nb: 0.85 |
| | 10 | 0.005 | 0.001 | 0.002 | 0.003 | 0.001 | 0.047 | 0.006 | 0.006 | 5.37 | Zr: 0.025, Hf: 0.21 |
| | 11 | 0.018 | 0.002 | 0.001 | 0.001 | 0.001 | 0.070 | 0.020 | 0.003 | 10.22 | Mg: 0.0019, Ca 0.0026 |
| | 12 | 0.003 | 0.002 | 0.001 | 0.002 | 0.004 | 0.055 | 0.005 | 0.007 | 14.12 | Y: 0.032, Ce 0.025 |
| | 13 | 0.001 | 0.009 | 0.002 | 0.002 | 0.001 | 0.077 | 0.010 | 0.005 | 3.46 | Zr: 0.019, La: 0.039 |
| | 14 | 0.004 | 0.005 | 0.002 | 0.001 | 0.002 | 0.075 | 0.009 | 0.005 | 4.03 | Ta: 1.74 |
| | 15 | 0.004 | 0.004 | 0.001 | 0.002 | 0.001 | 0.061 | 0.008 | 0.004 | 4.53 | Re: 2.48 |

TABLE 2-continued (continued from Table 1)

| Division | Alloy | Chemical composition (% by mass) Balance: Ni and impurities | | | | | | | | | |
|---|---|---|---|---|---|---|---|---|---|---|---|
| | | Sn | Pb | Sb | Zn | As | Nd + 13.4 × B | Sn + Pb | Sb + Zn + As | Mo + 0.5 × W | Others |
| Comparative examples | A | 0.001 | 0.003 | 0.004 | 0.002 | 0.001 | 0.059 | 0.004 | 0.007 | 6.02 | — |
| | B | 0.003 | 0.003 | 0.001 | 0.003 | 0.002 | 0.056 | 0.006 | 0.006 | 1.57 | — |
| | C | 0.002 | 0.003 | 0.002 | 0.001 | 0.003 | 0.057 | 0.005 | 0.006 | 6.18 | — |
| | D | 0.002 | 0.004 | 0.002 | 0.003 | 0.002 | 0.018 | 0.006 | 0.007 | 3.15 | — |
| | E | 0.003 | 0.005 | 0.001 | 0.002 | 0.002 | 0.051 | 0.008 | 0.005 | 3.13 | — |
| | F | 0.002 | 0.003 | 0.003 | 0.002 | 0.001 | *0.012 | 0.005 | 0.006 | 4.24 | — |
| | G | 0.003 | 0.003 | 0.003 | 0.002 | 0.001 | *0.139 | 0.006 | 0.006 | 4.35 | — |
| | H | *0.023 | 0.005 | 0.003 | 0.002 | 0.002 | 0.062 | *0.028 | 0.007 | 3.12 | — |
| | I | 0.003 | *0.012 | 0.002 | 0.001 | 0.003 | 0.054 | 0.015 | 0.006 | 3.85 | — |
| | J | 0.008 | 0.003 | *0.009 | 0.002 | 0.001 | 0.056 | 0.011 | *0.012 | 11.81 | — |
| | K | 0.004 | 0.002 | 0.002 | *0.009 | 0.003 | 0.030 | 0.006 | *0.014 | 9.91 | — |
| | L | 0.003 | 0.006 | 0.002 | 0.003 | *0.007 | 0.061 | 0.009 | *0.012 | 3.17 | — |
| | M | 0.018 | 0.009 | 0.003 | 0.001 | 0.002 | 0.060 | *0.027 | 0.006 | 3.14 | — |
| | N | 0.005 | 0.003 | 0.004 | 0.004 | 0.005 | 0.030 | 0.008 | *0.013 | 10.06 | — |

The mark * indicates falling outside the conditions regulated by the present invention.

Thus the obtained ingot was heated to 1160° C., and then was hot forged so that the finish temperature was 1000° C. to form a plate material having a thickness of 15 mm. After the hot forging, the plate material was air cooled.

From a middle portion in the thickness direction of the 15 mm thick plate material obtained by the above-mentioned hot forging, a round bar tensile test specimen, having a diameter of 10 mm and a length of 130 mm, was produced by machining the plate material in parallel to the longitudinal direction, and the tensile test specimen was used to evaluate the hot workability. That is to say, the high temperature ductility was evaluated by a high speed tensile test at high temperatures.

Specifically, the said round bar tensile test specimen was heated to 1180° C. and was held for 3 minutes, and then a high speed tensile test was conducted at a strain rate of 10/s. The hot workability at 1180° C. was evaluated by determining the reduction of area from the fracture surface after testing.

In addition, the said round bar tensile test specimen was heated to 1180° C. and was held for 3 minutes, and subsequently was cooled to 950° C. at a cooling rate of 100° C./min, and thereafter, a high speed tensile test was conducted at a strain rate of 10/s. The hot workability at 950° C. was evaluated by determining the reduction of area from the fracture surface after testing.

Moreover, using the 15 mm thick plate material obtained by the said hot forging, a softening heat treatment was carried out at 1100° C., and then the plate material was cold rolled so that the thickness thereof becomes 10 mm, and further, the cold rolled plate material was water cooled after being held at 1180° C. for 30 minutes.

Using a part of the above-described 10 mm thick plate material water cooled after being held at 1180° C. for 30 minutes, and from a middle portion in the thickness direction of the part, a round bar tensile test specimen having a diameter of 6 mm and a gage length of 30 mm, and a V-notch test specimen having a width of 5 mm, a height of 10 mm, and a length of 55 mm, which is specified in JIS Z 2242 (2005), were produced by machining the part in parallel to the longitudinal direction. A tensile test at room temperature was conducted on the said tensile test specimen in order to measure the elongation and evaluate the ductility, and a Charpy impact test at 0° C. was carried out on the said V-notch test specimen in order to measure the impact value and evaluate the toughness.

In addition, from a middle portion in the thickness direction of the same plate material, a round bar tensile test specimen, having a diameter of 6 mm and a length of 30 mm, was produced by machining the plate material in parallel to the longitudinal direction; the tensile test specimen was used to conduct a creep rupture test.

The creep rupture test was conducted in the air of 750° C. and 800° C., and by generalizing the obtained rupture strength using the Larson-Miller parameter method, the rupture strength at 750° C. in 10,000 hours was determined.

Furthermore, the remainder of the 10 mm thick plate material water cooled after being held at 1180° C. for 30 minutes was subjected to an aging treatment in which the plate material was held at 750° C. for 10000 hours, and then was water cooled.

From a middle portion in the thickness direction of the 10 mm thick plate material water cooled after an aging treatment, a round bar tensile test specimen, having a diameter of 6 mm and a length of 40 mm, was produced in parallel to the longitudinal direction. A tensile test at room temperature was conducted on the said tensile test specimen in order to measure the elongation and evaluate the ductility.

In addition, from a middle portion in the thickness direction of the same plate material subjected to the said aging treatment, a V-notch test specimen having a width of 5 mm, a height of 10 mm, and a length of 55 mm, which is specified in JIS Z 2242(2005), was produced in parallel to the longitudinal direction, and a Charpy impact test at 0° C. was conducted on the test specimen in order to measure the impact value and evaluate the toughness.

The results of the above-described tests are summarized in Table 3.

TABLE 3

| Test No. | Alloy | Reduction of area at 1180° C. (%) | Reduction of area at 950° C. (%) | Creep rupture strength at 750° C. × 10000 h (MPa) | Charpy impact value Before aging (J/cm$^2$) | Charpy impact value After aging (J/cm$^2$) | Elongation in tensile test Before aging (%) | Elongation in tensile test After aging (%) | Note |
|---|---|---|---|---|---|---|---|---|---|
| 1 | 1 | 91.2 | 87.3 | 165.2 | 265 | 71 | 64 | 41 | Inventive |
| 2 | 2 | 86.5 | 84.1 | 171.0 | 257 | 64 | 60 | 39 | examples |
| 3 | 3 | 82.3 | 78.2 | 175.8 | 249 | 60 | 61 | 38 | |
| 4 | 4 | 89.5 | 83.2 | 168.4 | 258 | 66 | 58 | 38 | |
| 5 | 5 | 88.4 | 84.0 | 170.2 | 262 | 68 | 59 | 40 | |
| 6 | 6 | 86.9 | 81.4 | 171.5 | 256 | 60 | 58 | 37 | |
| 7 | 7 | 82.4 | 82.5 | 170.8 | 254 | 58 | 60 | 40 | |
| 8 | 8 | 81.0 | 75.1 | 172.4 | 247 | 57 | 56 | 37 | |
| 9 | 9 | 82.1 | 84.6 | 174.5 | 253 | 55 | 58 | 38 | |
| 10 | 10 | 83.6 | 82.9 | 173.2 | 252 | 58 | 60 | 41 | |
| 11 | 11 | 82.4 | 72.6 | 173.0 | 245 | 52 | 58 | 38 | |
| 12 | 12 | 80.2 | 79.7 | 171.3 | 248 | 60 | 61 | 37 | |
| 13 | 13 | 88.2 | 84.2 | 169.8 | 256 | 62 | 59 | 40 | |
| 14 | 14 | 87.8 | 82.4 | 169.6 | 260 | 69 | 62 | 43 | |
| 15 | 15 | 82.7 | 76.2 | 175.1 | 249 | 54 | 56 | 37 | |
| 16 | * A | 68.2 | 83.8 | 164.2 | 260 | 66 | 61 | 39 | Comparative |
| 17 | * B | 93.0 | 89.1 | 154.2 | 263 | 74 | 63 | 44 | examples |
| 18 | * C | 68.8 | 83.2 | 159.4 | 259 | 64 | 58 | 37 | |
| 19 | * D | 91.4 | 67.4 | 158.1 | 255 | 62 | 57 | 38 | |
| 20 | * E | 90.5 | 64.8 | 157.9 | 257 | 63 | 60 | 37 | |
| 21 | * F | 89.3 | 65.5 | 163.7 | 260 | 65 | 61 | 39 | |
| 22 | * G | 69.4 | 68.2 | 164.0 | 261 | 66 | 57 | 41 | |
| 23 | * H | 89.7 | 84.1 | 165.0 | 251 | 19 | 59 | 15 | |
| 24 | * I | 84.2 | 80.8 | 171.2 | 250 | 28 | 60 | 14 | |
| 25 | * J | 81.7 | 82.0 | 168.9 | 252 | 21 | 57 | 11 | |
| 26 | * K | 80.1 | 72.9 | 171.7 | 243 | 25 | 55 | 14 | |
| 27 | * L | 89.3 | 85.3 | 164.8 | 250 | 24 | 58 | 16 | |
| 28 | * M | 89.0 | 84.1 | 165.0 | 252 | 18 | 59 | 12 | |
| 29 | * N | 80.2 | 71.8 | 171.7 | 243 | 22 | 56 | 10 | |

The mark * indicates falling outside the conditions regulated by the present invention.

From Table 3, regarding the test Nos. 1 to 15 using the alloys 1 to 15, which are the inventive examples, it is apparent that all of the creep rupture strength, ductility and toughness before and after aging at 750° C. for 10,000 hours, and hot workability at 1180° C. and 950° C. are excellent.

In contrast, regarding the test Nos. 16 to 29 using the alloys A to N, which are the comparative examples deviating from the conditions regulated by the present invention, although the ductility and toughness before aging are equivalent to those of the above-mentioned test Nos. 1 to 15, being the inventive examples, at least one of the creep rupture strength, ductility and toughness after aging, and hot workability is poorer than that of the said test Nos. 1 to 15

That is to say, in the case of test No. 16, the alloy A contains Mo having almost the same value as that of the alloy 2 used in test No. 2 in the Mo equivalent represented by the formula of [Mo+0.5×W] and other constituent elements of almost the same amount as that of the said alloy 2. However, the said alloy A does not contain W; and therefore, the creep rupture strength and high temperature ductility at 1180° C. are low.

In the case of test No. 17, the chemical composition of the alloy B is almost equivalent to that of the alloy 1, used in the test No. 1. However, the W content of the said alloy B is "3.13%", which is lower than the value regulated by the present invention; and therefore the creep rupture strength is low.

In the case of test No. 18, the chemical composition of the alloy C is almost equivalent to that of the alloy 2, used in the test No. 2. That is to say, the Mo equivalent of the alloy C, represented by the formula of [Mo+0.5×W], is almost the same as that of the alloy 2. However, the said alloy C contains Mo, and therefore the W content thereof is "2.26%", which is lower than the value regulated by the present invention. And thus, in the case of test No. 18, the creep rupture strength and high temperature ductility at 1180° C. are low.

In the case of test No. 19, the chemical composition of the alloy D is almost equivalent to that of the alloy 1, used in the test No. 1. However, the said alloy D does not contain B; and therefore, the creep rupture strength and high temperature ductility at 950° C. are low.

In the case of test No. 20, the chemical composition of the alloy E is almost equivalent to that of the alloy 1, used in the test No. 1. However, the said alloy E does not contain Nd; and therefore, the creep rupture strength and high temperature ductility at 950° C. are low.

In the case of test No. 21, the chemical composition of the alloy F is almost equivalent to that of the alloy 4, used in the test No. 4. However, the value represented by the formula of [Nd+13.4×B] is lower than the value regulated by the present invention; and therefore the creep rupture strength and high temperature ductility at 950° C. are low.

In the case of test No. 22, the chemical composition of the alloy G is almost equivalent to that of the alloy 5, used in the test No. 5. However, the value represented by the formula of [Nd+13.4×B] is higher than the value regulated by the present invention; and therefore the creep rupture strength and high temperature ductility at 1180° C. and 950° C. are low.

In the case of test No. 23, the chemical composition of the alloy H is almost equivalent to that of the alloy 1, used in the test No. 1. However, the Sn content and the value represented by the formula of [Sn+Pb] are higher than those regulated by the present invention; and therefore the elongation and impact value after aging at 750° C. for 10,000 hours are remarkably low.

In the case of test No. 24, the chemical composition of the alloy I is almost equivalent to that of the alloy 6, used in the test No. 6. However, the Pb content is higher than that regulated by the present invention; and therefore the elongation and impact value after aging at 750° C. for 10,000 hours are remarkably low.

In the case of test No. 25, the chemical composition of the alloy J is almost equivalent to that of the alloy 7, used in the test No. 7. However, the Sb content and the value represented by the formula of [Sb+Zn+As] are higher than those regulated by the present invention; and therefore the elongation and impact value after aging at 750° C. for 10,000 hours are remarkably low.

In the case of test No. 26, the chemical composition of the alloy K is almost equivalent to that of the alloy 8, used in the test No. 8. However, the Zn content and the value represented by the formula of [Sb+Zn+As] are higher than those regulated by the present invention; and therefore the elongation and impact value after aging at 750° C. for 10,000 hours are remarkably low.

In the case of test No. 27, the chemical composition of the alloy L is almost equivalent to that of the alloy 1, used in the test No. 1. However, the As content and the value represented by the formula of [Sb+Zn+As] are higher than those regulated by the present invention; and therefore the elongation and impact value after aging at 750° C. for 10,000 hours are remarkably low.

In the case of test No. 28, the chemical composition of the alloy M is almost equivalent to that of the alloy 1, used in the test No. 1. However, the value represented by the formula of [Sn+Pb] is higher than that regulated by the present invention; and therefore the elongation and impact value after aging at 750° C. for 10,000 hours are remarkably low.

In the case of test No. 29, the chemical composition of the alloy N is almost equivalent to that of the alloy 8, used in the test No. 8. However, the value represented by the formula of [Sb+Zn+As] is higher than that regulated by the present invention; and therefore the elongation and impact value after aging at 750° C. for 10,000 hours are remarkably low.

Industrial Applicability

The Ni-base heat resistant alloy of the present invention is an alloy in which much higher strength than the conventional Ni-base heat resistant alloy can be achieved, the ductility and toughness after a long period of use at a high temperature are remarkably improved, and moreover the zero ductility temperature and the hot workability are also further improved. Therefore, this Ni-base heat resistant alloy can be suitably used as a pipe material, a thick plate material for a heat resistant pressure member, a bar material, a forging, and the like for a boiler for power generation, a plant for chemical industry, and the like.

What is claimed is:

1. A Ni-base heat resistant alloy, which comprises by mass percent, C: 0.1% or less, Si: 1% or less, Mn: 1% or less, Cr: not less than 15% to less than 28%, Fe: 15% or less, W: more than 5% to not more than 20%, Al: more than 0.5% to not more than 1.65%, Ti: more than 0.5% to not more than 2%, Nd: 0.001 to 0.1% and B: 0.0005 to 0.01%, with the balance being Ni and impurities, in which the contents of P, S, Sn, Pb, Sb, Zn and As among the impurities are P: 0.03% or less, S: 0.01% or less, Sn: 0.020% or less, Pb: 0.010% or less, Sb: 0.005% or less, Zn: 0.005% or less and As: 0.005% or less, and further satisfies the following formulas (1) to (3):

$$0.015 \leqq Nd+13.4\times B \leqq 0.13 \quad (1),$$

$$Sn+Pb \leqq 0.025 \quad (2),$$

$$Sb+Zn+As \leqq 0.010 \quad (3);$$

wherein each element symbol in the formulas (1) to (3) represents the content by mass percent of the element concerned.

2. The Ni-base heat resistant alloy according to claim 1, which further contains, by mass percent, one or more elements of 15% or less Mo satisfying the following formula (4) and 20% or less of Co in lieu of a part of Ni:

$$Mo+0.5\times W \leqq 18 \quad (4);$$

wherein each element symbol in the formula (4) represents the content by mass percent of the element concerned.

3. The Ni-base heat resistant alloy according to claim 1, which further contains, by mass percent, one or more elements of one or more groups selected from the following groups <1> to <3> in lieu of a part of Ni:

<1> Nb: 1.0% or less, V: 1.5% or less, Zr: 0.2% or less and Hf: 1.0% or less,

<2> Mg: 0.05% or less, Ca: 0.05% or less, Y: 0.5% or less, La: 0.5% or less, and Ce: 0.5% or less, <3> Ta: 8% or less and Re: 8% or less.

4. The Ni-base heat resistant alloy according to claim 2, which further contains, by mass percent, one or more elements of one or more groups selected from the following groups <1> to <3> in lieu of a part of Ni:

<1> Nb: 1.0% or less, V: 1.5% or less, Zr: 0.2% or less and Hf: 1.0% or less,

<2> Mg: 0.05% or less, Ca: 0.05% or less, Y: 0.5% or less, La: 0.5% or less, and Ce: 0.5% or less, <3> Ta: 8% or less and Re: 8% or less.

* * * * *